US006203970B1

(12) United States Patent
Chari

(10) Patent No.: US 6,203,970 B1
(45) Date of Patent: Mar. 20, 2001

(54) PHOTOGRAPHIC ELEMENT WITH POROUS MEMBRANE OVERCOAT

(75) Inventor: Krishnan Chari, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/464,949

(22) Filed: Dec. 16, 1999

(51) Int. Cl.[7] ..... G03C 11/06; G03C 11/08; G03C 1/74; G03C 1/76

(52) U.S. Cl. ..... 430/350; 430/531; 430/533; 430/536; 430/537; 430/961

(58) Field of Search ..... 430/350, 215, 430/531, 533, 536, 537, 961

(56) References Cited

U.S. PATENT DOCUMENTS

| | | | | |
|---|---|---|---|---|
| 2,706,686 | * | 4/1955 | Hilborn | 430/350 |
| 3,756,816 | * | 9/1973 | Sullivan | 430/215 |
| 3,785,815 | * | 1/1974 | Avtges et al. | 430/215 |
| 3,856,522 | * | 12/1974 | George | 430/215 |
| 3,888,669 | * | 6/1975 | Cardone | 430/215 |
| 5,441,854 | * | 8/1995 | Texter et al. | 430/215 |
| 5,853,926 | | 12/1998 | Bohan et al. | 430/350 |
| 5,856,051 | | 1/1999 | Yau et al. | 430/537 |
| 5,952,130 | | 9/1999 | Yau et al. | 430/536 |

OTHER PUBLICATIONS

"Synthetic Polymeric Membranes" by Robert E. Kesting, McGraw–Hill Book Company, New York, 1971 (see in particular Chapter 5: Porous Phase–inversion Membranes). Chapter 8 "Production of Microporous Media by Phase–Inversion Processes" in Materials Science of Synthetic Membranes, by H. Strathmann, ACS Symposium Series No. 269, 1985.

* cited by examiner

*Primary Examiner*—Richard L. Schilling
(74) *Attorney, Agent, or Firm*—J. Jeffrey Hawley

(57) ABSTRACT

A photosensitive photographic element is described which comprises a support having at least one ? hydrophilic silver halide containing layer. On the hydrophilic silver halide containing layers there is an overcoat layer. The overcoat layer comprises a hydrophobic thermoplastic polymer that is present in the form of a porous membrane. The pores of the membrane are occupied by a hydrophilic composition. In another aspect, there is provided a method of making a photosensitive photographic element comprising a support having a hydrophilic silver halide containing layer and an overcoat layer, the overcoat layer comprising a hydrophobic thermoplastic polymer that is present in the form of a porous membrane wherein the pores of said membrane are occupied by a hydrophilic composition, said method comprising the steps of:

(a) forming a solution of said hydrophobic thermoplastic polymer and said hydrophilic component in a solvent, (b) coating said solution on said hydrophilic silver containing layer, and (c) removing said solvent.

An image can be produced in the element by the steps of:

(1) exposing the photographic element described above so as to produce a photographic latent image in the silver halide layer, (2) processing the photographic element in a manner such that the hydrophilic compound is removed from the overcoat membrane, and (3) heating the processed photographic element so as to soften the hydrophobic thermoplastic polymer thereby closing the pores and producing a clear overcoat layer.

8 Claims, No Drawings

PHOTOGRAPHIC ELEMENT WITH POROUS MEMBRANE OVERCOAT

FIELD OF THE INVENTION

The present invention relates to photographic elements having a protective overcoat. The overcoat is present before exposure and processing and comprises a hydrophobic thermoplastic polymer that is present in the form of a porous membrane wherein the pores are occupied by a hydrophilic composition. During processing of the photographic element, the hydrophilic composition allows processing solution to pass through the membrane to the photosensitive layers in the element. During processing, the hydrophilic composition is removed from the overcoat. In the final step of processing, the element is heated so as to soften the hydrophobic thermoplastic polymer hereby forming a water resistance protective layer for the element.

DESCRIPTION RELATIVE TO THE PRIOR ART

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide is then removed from the photographic element, leaving a dye image.

In either case, formation of the image commonly involves liquid processing with aqueous solutions that must penetrate the surface of the element to come into contact with silver halide and, in the case of color elements, color forming compounds. Thus, gelatin, and similar natural or synthetic hydrophilic polymers, has proven to be the binder of choice for silver halide photographic elements. After processing, the photographic element, particularly where the element is a photographic print, is subjected to handling by the ultimate customer. Unfortunately, when gelatin, or similar polymers, are formulated so as to facilitate contact between the silver halide crystal and aqueous processing solutions, they are not as tough and mar-resistant as would be desired for something that is extensively handled after processing. Thus, fingerprints can easily mark the imaged element, it can be scratched or torn and it can swell or otherwise deform when it is contacted with liquids.

While numerous post-processing treatments have been proposed for photographic elements, it would be desirable to provide for a protective overcoat layer that could be incorporated as part of the photographic element as manufactured. This would eliminate the need for post-processing application of protective materials. Recently, there have been several proposals for protective overcoats that are part of the photographic element as manufactured. For example, in U.S. Pat. No. 5,856,051 there is described a protective overcoat applied during manufacture that comprises hydrophobic polymer particles with gelatin as a binder. Optionally, a relatively low molecular weight polymer is included in the composition to improve processing of the underlying photosensitive layers. In U.S. Pat. No. 5,853,926 there is described a similar overcoat including polymer particles in a soft polymer binder.

While the inventions in both the '051 and the '926 patents provide for desirable overcoats, continuous improvements were sought. These overcoat materials do not form porous membranes. For example, the materials used in the '051 patent are polymeric particles such as waxes (see col. 3 lines 13–25) which are extremely soft. Harder materials would be desirable to form more abrasion resistant overcoats. Further, during long term keeping, the low glass transition temperature of these materials causes some coalescence and this has a detrimental effect on processability.

SUMMARY OF THE INVENTION

In accordance with the present invention there is provided a photosensitive photographic element comprising a support having a hydrophilic silver halide containing layer and an overcoat layer, the overcoat layer comprising a hydrophobic thermoplastic polymer that is present in the form of a porous membrane wherein the pores of said membrane are occupied by a hydrophilic composition. Preferably, the refractive index of the hydrophobic thermoplastic polymer and the refractive index of the hydrophilic composition are such that the porous layer is substantially transparent.

In another aspect of the present invention there is provided a method for producing an image in a photographic element comprising the steps of:

(1) exposing the photographic element described above so as to produce a photographic latent image in the silver halide layer, (2) processing the photographic element in a manner such that the hydrophilic compound is removed from the overcoat membrane, and (3) heating the processed photographic element so as to soften the hydrophobic thermoplastic polymer hereby closing the pores and producing a clear overcoat layer.

DETAILED DESCRIPTION OF THE INVENTION

Any solid hydrophobic thermoplastic polymer may be used in the formation of the membrane. Examples include ethyl cellulose, cellulose acetate, polyethylene, cellulose diacetate, polyvinyl chloride, cellulose nitrate, polysulfone, polypropylene, polystyrene, poly(ethylene terephthalate), polyamides, poly(butylene terephthalate), poly(methyl methacrylate), polycarbonate, poly(tetrafluoroethylene), poly(vinylidene fluoride). It is preferred that the material chosen has a Tg of 200° C. or less. The currently preferred material is ethyl cellulose.

The hydrophilic compound or composition may include any water-soluble organic or inorganic materials. It is preferred that said materials are of low molecular weight (below 1000). Preferred materials are low molecular weight surfactants or polymers that are compatible with the above hydrophobic components. Examples include sodium dodecyl sulfate, sodium bis(2 ethyl hexyl sulfosuccinate (Aerosol™ OT) from Cytec Industries (formerly American Cyanamid), sodium tetradecyl sulfate, sodium dodecyl benzene sulfonate, sorbitan monooleate(SPAN™ 80) from ICI Americas, poly(vinyl alcohol), poly(vinyl pyrrolidone), poly (ethylene oxide), polyoxyethylene sorbitan monooleate (TWEEN™ 80) from ICI Americas. Useful surfactants are also described in U.S. Pat. No. 3,378,507. The preferred membrane includes ethyl cellulose as the hydrophobic thermoplastic polymer and sodium bis(2-ethyl hexyl sulfosuccinate) as the hydrophilic composition because of the close match in refractive index.

Other common addenda, such as hardeners, spreading agents, charge control agents, dry scratch resistance compounds and lubricants can also be included in the formulation as needed.

The overcoats useful in the present invention can be highly porous. Highly porous membranes facilitate the processing of the underlying exposed photosensitive layers. However, it is well known that highly porous membranes are substantially opaque. Incorporating an index of refraction matched hydrophilic component renders the described membrane substantially transparent. Thus, the underlying photosensitive layers can be exposed through the unprocessed overcoat layer. It is preferred to make the membrane layer highly porous thereby making the hydrophilic component of the layer be in the majority. Preferably, the weight ratio of hydrophobic thermoplastic polymer to hydrophilic component is between about 1:0.5 and 1:5 and more preferably between about 1:1 and 1:3. Too much surfactant results in an unprocessed element with an undesirably tacky surface.

The described membranes are sometimes referred to as "phase inversion membranes". Such membranes are described, for example, in "Synthetic Polymeric Membranes" by Robert E. Kesting, McGraw-Hill Book Company, New York, 1971 (see in particular Chapter 5: Porous Phase-inversion Membranes). In the terminology of that reference, the hydrophobic thermoplastic polymer is the matrix and has embedded therein the hydrophilic component in the form of droplets. In the present invention, the droplets, which fill the voids or vacuoles in the matrix, are not removed until the photographic element is processed.

In the examples presented below, ethyl cellulose is illustrated. Kesting shows the formation of similar membranes, although without the hydrophilic composition present, using cellulose nitrate and cellulose acetate. Other references, such as Chapter 8 "Production of Microporous Media by Phase-Inversion Processes" in Materials Science of Synthetic Membranes, by H. Strathmann, ACS Symposium Series No. 269, 1985, show other useful membrane forming materials. Useful materials which are illustrated include cellulose acetate E-393-3 from Eastman Chemical Company; polysulfone PS 1700 from Union Carbide; and an aromatic polyamide, Nomex™ from DuPont.

The coverage of the unprocessed overcoat layer of the invention can vary widely. Typical useful coverages range from about 0.3 to 25 g/m$^2$. After processing and sealing, this corresponds to about 0.2 to 5 g/m$^2$.

The membrane useful in the invention is coated using an organic solvent. Useful organic solvents include methyl acetate, ethanol, butanol and mixtures thereof. As taught by Kesting cited above, a multisolvent mixture is particularly useful in forming the described membrane. It is desirable to use a mixture of solvents that represent a range of boiling points. This provides for gradual and controlled evaporation. It is preferred to have a low boiling point true solvent for the hydrophobic thermoplastic polymer; a higher boiling point solvent in which the hydrophobic thermoplastic polymer is less soluble which serves as a swelling agent; and a still higher boiling solvent which is a non-solvent for the hydrophobic thermoplastic polymer but which is a solvent for the hydrophilic composition. The hydrophilic composition is not soluble in the true solvent for the hydrophobic thermoplastic polymer but should be soluble in the higher boiling polar organic solvents. Some water can be also present to aid in the dissolution of the hydrophilic composition.

Another method for forming the membrane useful in the invention is by HIPR or "high internal phase ratio" emulsions as described by Lissant in Journal of Colloid and Interface Science 22, 462–468 (1966).

The overcoat of the invention is applied from a coating composition. The coating composition includes the hydrophobic thermoplastic polymer, the hydrophilic composition, any other addenda all dissolved in a solvent. The weight ratio of solids to solvent is not critical and can range from about 1:1 solids:solvent to 1:50.

After the processing of the photographic image, the hydrophilic component has been removed from the overcoat membrane layer and the layers is ready for heat treatment or "sealing", so as to close the pores in the layer. Heating can be accomplished by any convenient method such as by passing the element through heated rollers. Heated rollers such as those used in the fusing station of electrophotographic copying machines can be used. Other methods are useful such as impinging the layer with heated air; and irradiating with a heat lamp. The overcoat layer should be brought up to a temperature and for a time sufficient to soften the hydrophobic thermoplastic polymer and substantially close the pores. This will vary depending on the specific polymer used. During the heating step, particularly where heated rollers are used, the surface can be protected with a high temperature resistant polymer sheet. The material of the sheet should be chosen so as to not stick to the hydrophobic thermoplastic polymer.

Photographic elements according to one aspect of the invention are provided wherein the overcoat composition is present before exposure and processing of the photographic element. Since the photographic image must be exposed through the overcoat material, the material must be substantially transparent. It is as highly preferred that the index of refraction of the hydrophobic thermoplastic polymer and the hydrophilic composition that fills the pores of this polymer be closely matched. It is preferred that the index of refraction of the hydrophilic composition be within about plus or minus 0.01 of the refractive index of the hydrophobic polymer. Still more preferably, the refractive index is within plus or minus 0.005.

The photographic elements protected in accordance with this invention are derived from silver halide photographic elements. The elements can be black and white elements (for example, those which yield a silver image or those which yield a neutral tone image from a mixture of dye forming couplers), single color elements or multicolor elements. Multicolor elements typically contain dye image forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. Photographic elements protected in accordance with the present invention may also include a magnetic recording material. Elements of this type are described in Research Disclosure, Item 34390, November 1992. The elements can include transparent magnetic recording layer such as a layer containing magnetic particles on the underside of a transparent support as described in U.S. Pat. Nos. 4,279,945 and 4,302,523. Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

In the case of photographic prints, a new and more durable support has been developed using biaxially oriented polyolefin layers. This support is generally described in U.S. Pat. Nos. 5,866,282 and 5,859,965. The combination of this more durable support with the overcoat of the invention produces a highly desirable finished photographic print. Thus, in a preferred aspect of the invention, there is provided a photographic element comprising a paper base, at least one photosensitive silver halide layer, and a layer of biaxially oriented polyolefin sheet between the top of the paper base and the silver halide layer. The element further comprises an overcoat layer of the invention over the silver halide layer.

The photographic element of the invention may have copy restriction features incorporated such as disclosed in U.S. patent application Ser. No. 08/598,785 filed Feb. 8, 1996 and application Ser. No. 08/598,778 filed on the same day. These applications disclose rendering a document or image copy restrictive by embedding into the element a pattern of invisible microdots. These microdots are, however, detectable by the electro-optical scanning device of a digital document copier. The pattern of microdots may be incorporated throughout the document or image. These photographic elements may also have colored edges or an invisible microdot pattern on the back side to enable users or machines to read and identify the media. The elements may take the form of sheets that are capable of bearing an image. Typical of such materials are photographic paper and film materials composed of polyethylene resin coated paper, polyester, (poly)ethylene naphthalate, and cellulose triacetate based materials.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and meth-acrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.). Images can be developed in photographic elements in any of a number of well known photographic processes utilizing any of a number of well known processing compositions, described, for example, in T. H. James, editor, The Theory of the Photographic Process, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing certain color reversal elements, the element is first treated with a black and white developer (that is, a developer that does not form colored dyes with the coupler compounds). This treatment is followed by a treatment to render developable unexposed silver halide (usually chemical or light fogging), that is then followed by treatment with a color developer. Development is followed by bleach-fixing, to remove silver or silver halide, washing and drying.

EXAMPLE 1

This example illustrates the effect of composition of the overcoat on its wettability. The wettability is based on contact angle of a drop of water placed on the surface. A low value of the contact angle (close to zero) indicates good wettability whereas a high value of the contact angle (greater than 60) indicates a relatively hydrophobic surface.

Solutions for coating were prepared as follows:

Composition A (control): This composition consisted of a mixture of 2.8 grams of hydrophobic thermoplastic polymer (ethylcellulose (ETHOCEL™ Standard 45)) refractive index 1.47; weight average molecular weight ~158,000), 55.6 mL of methyl acetate, 26.3 mL of ethyl alcohol, 13.6 mL of butyl alcohol, 2.9 mL of distilled water, 1.1 grams of glycerol and 1.0 grams of coating aid (CX-100). CX 100 is a polyfunctional azridine crosslinking agent used as an adhesion promoter and is available from Zenica Resins.

Composition B (invention): This composition was the same as composition A but contained, in addition, 7.0 grams of the anionic surfactant sodium bis(2-ethyl hexyl sulfosuccinate) (Aerosol™ OT)(refractive index 1.47).

Composition C (invention): Same as composition A but contained, in addition, 14.0 grams of Aerosol™ OT.

The solutions were spread on a 310 $cm^2$ area of sensitized Ektacolor™ photographic paper from Eastman Kodak at 57° C. using a casting knife having a 0.015 cm gap. The coatings were then placed in an air dryer at 38° C. for one hour. After the coatings had dried they were cut into two 155 $cm^2$ strips. One of the strips was left alone and the other was washed in running water at 37° C. for 3 minutes and then dried for 1 hour in an air dryer at 38° C. The washed coating was then further divided into two strips of approximately 77 $cm^2$ each. One of these was placed under a thin layer of Mylar™ and heat-sealed using rollers at 200° C. and 5.6 $kg/cm^2$.

Equilibrium contact angles for a drop of distilled water on the unwashed, washed and washed and sealed coatings were then determined at room temperature (22° C.) and are shown in Table 1.

TABLE 1

| | Equilibrium Contact Angle (Degrees) | | |
|---|---|---|---|
| Composition | Before Washing | After Washing | After Sealing |
| A (comparative) | 66 | 70 | 71 |
| B (invention) | 13 | 69 | 83 |
| C (invention) | 5 | 49 | 64 |

It is clear that the invention compositions of the invention B and C show significantly better discrimination in wetting behavior between the unwashed and washed coatings. The surface of coating C in the three stages; i.e. unwashed, washed and washed and sealed was characterized using scanning electron microscopy (SEM). The results clearly show the presence of the surfactant filler material in the first stage, the high porosity polymer network in the second stage and the sealed polymer surface in the third stage.

EXAMPLE 2

This example illustrates the effect of the overcoat of the invention on sensitometry and post-process stain resistance.

Solutions for coating were prepared having compositions shown in Table 2. Ethocel™ (as above) was the hydrophobic polymer; Aerosol™ (as above) was the hydrophilic component of the overcoat layer; and methyl acetate (Me-Ac), ethanol and butanol were the solvents (as above). Composition "D", not having a hydrophilic component, is a comparative example and thus the designation "(c)".

TABLE 2

| Comp | Ethocel ™ | Aerosol ™ | Me-Ac | Ethanol | Butanol |
|---|---|---|---|---|---|
| D (c) | 2 g | 0 g | 55.8 mL | 25.5 mL | 13.7 mL |
| E | 1 g | 2 g | 55.8 mL | 25.5 mL | 13.7 mL |
| F | 2 g | 4 g | 32.7 mL | 40.5 mL | 21.7 mL |

In addition to the above ingredients the solutions also contained 3 grams of distilled water, 1.1 grams of glycerol and 1 gram of the coating aid CX-100.

The solutions were coated at a laydown of 129 mL/m$^2$ on sensitized photographic paper. The coated material went through a setting section that was maintained at 71° C. followed by two dryers. Each of the dryers was at 71° C. The coating speed was maintained at 3.7 m/min giving a residence time of 3 min in the setting section, 2.5 min in the first dryer and 3.5 min in the second dryer. A control without any overcoat (coating G) was also included.

35 mm strips were obtained from these coatings. The strips were exposed using a 0–3 step tablet and processed by the standard RA-4 process. The processed strips were then placed under Mylar™ and heat sealed using rollers at 200° C. and 5.6 kg/cm$^2$. The processed and sealed strips were read by status A densitometry. The density at minimum exposure (Dmin) and the density at maximum exposure (Dmax) were noted. Strips from coatings F and G were also subjected to a stain test. The strips were dipped in a solution of Ponceau red (prepared by combining 1 gram of Ponceau red dye, 50 grams of acetic acid and 950 grams of distilled water) for 5 minutes. They were then rinsed under running distilled water for 2 minutes and then dried in an air dryer at 38° C. The reflection density due to stain was then measured in a spectrophotometer at a wavelength of 500 nm. The results are shown in Table 3 below.

TABLE 3

| | Dmin | | | Dmax | | | |
|---|---|---|---|---|---|---|---|
| | Red | Green | Blue | Red | Green | Blue | Stain |
| D (c) | 0.55 | 0.40 | 0.40 | 0.55 | 0.43 | 0.43 | — |
| E | 0.22 | 0.14 | 0.18 | 2.28 | 2.22 | 2.08 | — |
| F | 0.17 | 0.16 | 0.19 | 2.18 | 2.13 | 2.07 | 0.02 |
| G (c) | 0.12 | 0.12 | 0.06 | 2.15 | 2.15 | 2.20 | 1.34 |

Comparative example D, having an overcoat with no hydrophilic component, exhibits a Dmin and a Dmax which are substantially the same indicating no development. Example E shows good sensitometry. Example F, which also includes an overcoat with both the hydrophobic thermoplastic polymer and the hydrophilic composition shows good sensitometry and excellent results on the stain test. Comparative example G, with no overcoat, shows good sensitometry but extremely high stain.

What is claimed is:

1. A photosensitive photographic element comprising a support having a hydrophilic silver halide containing layer and an overcoat layer, the overcoat layer comprising a hydrophobic thermoplastic polymer that is present in the form of a porous membrane wherein the pores of said membrane are occupied by a hydrophilic composition, which is a surfactant.

2. An element according to claim 1 wherein wherein said hydrophobic thermoplastic polymer is ethylcellulose and wherein said surfactant is sodium bis(2-ethyl hexyl sulfosuccinate).

3. An element according to claim 1 wherein the weight ratio of hydrophobic thermoplastic polymer to hydrophilic component is between about 1:0.5 and 1:5.

4. An element according to claim 1 the coverage of said overcoat layer is between about 0.3 to 25 g/m$^2$.

5. An element according to claim 1 wherein the coverage of said overcoat layer after processing and sealing is between about 0.2 to 5 g/m$^2$.

6. An element according to claim 1 wherein the difference between the index of refraction of said hydrophilic composition and said hydrophobic polymer is within about plus or minus 0.01.

7. A method of making a photosensitive photographic element comprising a support having a hydrophilic silver halide containing layer and an overcoat layer, the overcoat layer comprising a hydrophobic thermoplastic polymer that is present in the form of a porous membrane wherein the pores of said membrane are occupied by a hydrophilic composition, which is a surfactant, said method comprising the steps of:

(a) forming a solution of said hydrophobic thermoplastic polymer and said hydrophilic component in a solvent, (b) coating said solution on said hydrophilic silver containing layer, and (c) removing said solvent.

8. A method for producing an imaged photographic element comprising the steps of:

(1) exposing a photosensitive photographic element comprising a support having a hydrophilic silver halide containing layer and an overcoat layer, the overcoat layer comprising a hydrophobic thermoplastic polymer that is present in the form of a porous membrane wherein the pores of said membrane are occupied by a hydrophilic composition, which is a surfactant, so as to produce a photographic latent image in said silver halide layer, (2) processing said exposed photographic element in a manner such that said hydrophilic compound is removed from said overcoat membrane, and (3) heating said processed photographic element so as to soften the hydrophobic thermoplastic polymer thereby closing the pores and producing a clear overcoat layer.

* * * * *